US005171033A

United States Patent [19]

Olson et al.

[11] Patent Number: 5,171,033

[45] Date of Patent: Dec. 15, 1992

[54] VENTILATED BOOT AND IN-LINE ROLLER SKATE WITH THE SAME

[75] Inventors: Brennan J. Olson; John F. Swigart, both of Minneapolis, Minn.

[73] Assignee: Rollerblade, Inc., Minneapolis, Minn.

[21] Appl. No.: 547,230

[22] Filed: Jul. 3, 1990

[51] Int. Cl.[5] ..... A63C 17/06

[52] U.S. Cl. ..... 280/11.22; 36/3 R; 36/115

[58] Field of Search ..... 280/11.22, 11.23, 11.19, 280/11.3, 11.1; 36/115, 120, 121, 3 A, 3 R, 54

[56] References Cited

U.S. PATENT DOCUMENTS

| | | | |
|---|---|---|---|
| D. 327,360 | 6/1992 | Graham | D2/276 |
| 2,666,207 | 1/1954 | Lucas | 36/3 A |
| 3,045,367 | 7/1962 | McKeon | 36/72 |
| 3,718,994 | 3/1973 | Spier | 36/2.5 R |
| 3,798,804 | 3/1974 | Funck | 36/72 R |
| 3,829,111 | 8/1974 | Nicholls | 280/11.3 |
| 3,963,252 | 6/1976 | Carlson | 280/11.22 |
| 4,107,856 | 8/1978 | Bourque | 36/115 |
| 4,268,981 | 5/1981 | Olivieri | 36/115 |
| 4,408,403 | 10/1983 | Martin | 36/115 |
| 4,447,967 | 5/1984 | Zaino | 36/45 |
| 4,507,880 | 4/1985 | Ohashi | 36/115 |
| 4,509,276 | 4/1985 | Bourque | 36/115 |
| 4,693,021 | 9/1987 | Mazzarolo | 36/3 A |
| 4,708,352 | 11/1987 | Vullierme | 280/11.3 |
| 4,771,555 | 9/1988 | Ohashi | 36/3 A |
| 4,835,885 | 6/1989 | Hoshizaki et al. | 36/115 |
| 4,837,948 | 6/1989 | Cho | 36/3 A |
| 4,909,523 | 3/1990 | Olson | 280/11.2 |
| 4,920,666 | 5/1990 | Marega | 36/54 |

FOREIGN PATENT DOCUMENTS

| | | | |
|---|---|---|---|
| 0349943 | 1/1989 | European Pat. Off. . | |
| 3228017 | 7/1983 | Fed. Rep. of Germany | 36/3 R |
| 2484215 | 12/1981 | France . | |

OTHER PUBLICATIONS

Rollerblade "Skates+" Catalog 1989-1990.

*Primary Examiner*—David M. Mitchell

*Attorney, Agent, or Firm*—Merchant, Gould, Smith, Edell, Welter & Schmidt

[57] ABSTRACT

Disclosed is an improved in-line roller skate that cools and drys a skater's foot, provides increased performance, and increased comfort. The skate of the present invention includes a boot having a plurality of venting apertures selectively located therein so as to achieve an interchange of air between the inside of the boot and the external environment thereby providing a cooling and drying circulation of air with in the boot of the in-line roller skate. A skate according to the present invention further includes a cuff pivoting on a pair of guide rails attached to the boot.

15 Claims, 3 Drawing Sheets

VENTILATED BOOT AND IN-LINE ROLLER SKATE WITH THE SAME

The present invention relates generally to in-line roller skates and in particular to the boots used on such skates.

BACKGROUND OF THE PRESENT INVENTION

An in-line roller skate includes a plurality of wheels rotatable in a common plane and carried by a frame attached to a skate boot. An in-line skate, then, has a lateral support base equal to the width of contact between the wheels and the skating surface, typically on the order of about 0.5 centimeters. This narrow support base makes balancing on the wheels difficult, especially for the novice skater.

While balancing in the forward/rearward direction is usually only a matter of experience, balancing in the sideward or lateral directions is a matter of sufficient ankle strength and of adequate lateral ankle support from the skate boot. That this difference exists arises from the anatomy of the lower leg and foot, which allows lateral flexibility and provides little support to an individual's ankles in the lateral direction. A skater's ankle therefore has a tendency toward lateral bending. In sum, because an in-line roller skater has to balance on a plurality of wheels rotating in a common plane and having minimal surface contact with the skating surface, the provision of lateral ankle support is an important factor in proper, safe, and enjoyable use of an in-line skate.

When searching for a way to increase lateral ankle support, it was observed that the boots used for downhill snow skiing provide the additional support sought after.

To solve the problem of inadequate ankle support, then, the ski-type boot was adopted for use on in-line roller skates with minimal modification. But in doing so, a boot designed for cold weather has been widely adopted for use in the warm and often very hot weather conditions that in-line skaters encounter. The result has been that the skater's feet are often hot, damp, and uncomfortable in the tight, nonporous, and stiff ski-type boots.

Ski boots are generally formed of a nonporous, synthetic material such as polyeurathane. These boots include a rigid shell that securely supports a skier's ankle and protects the foot from injury. The rigidity of the shell also provides the skier with better control over the long skis extending forwardly and rearwardly of the boot than would be provided by a boot made of a flexible material such as leather. Because of the nonporous nature of the boot material, they do not breathe and allow no air flow through the walls of the boot. In addition, ski boots are constructed to minimize air exchange between the inside of the boot and the cold skiing environment, striving to retain body generated heat. As a result, extensive heat accumulates in the boot during skate use. Such heat is generated in the boot due to often high ambient temperatures associated with the warm summer days when skating is done, from frictional movement of the foot within the boot, from increased circulation of blood to the feet and lower legs due to vigorous skating activity, from heat transfer from wheels and wheel bearings which heat up during prolonged skating, and from the often very hot asphalt or concrete skating surface. Skating surfaces such as black asphalt, which readily absorb solar and infrared radiation become very hot, and significantly increase temperatures within the boot. Finally many of the boots have a black or dark coloration that readily absorbs solar heat. All these factors contribute to heat build up in the boot.

Besides the problem of heat buildup within the boot, moisture from a skater's perspiring foot also accumulates in the boot in response to the warm boot and physical activity. As with the heat build-up, the moisture accumulation is due primarily to an inability of air to circulate into and out of the boot and carry such moisture away, but the excessive heat aggravates the moisture accumulation problem because the skater's foot perspires more with increasing heat levels in an effort to remain cool and to perform its share of dissipating the heat generated by the rest of the body during skating activity. The end result of the heat and moisture problems is that the presently available boots are much less comfortable to use than a skater would desire.

In addition, the synthetic material ski-type boot utilized by in-line skates, while providing excellent lateral stiffness and rigidity for lateral ankle support, provides unnecessary as well as unwanted forward/rearward stiffness and rigidity. This boot characteristic inhibits the performance abilities of the skate because it limits the range of motion of the skater's legs and feet and therefore the ability of the skater to utilize the full extent of his muscular strength.

A third shortcoming of the ski-type boot is its heavy weight and thick wall which were needed by the skier for downhill skiing. This weight posed little problem for a skier relying generally on gravity for forward downhill motion and where one's foot need not be lifted from the ground. An in-line skater, by contrast, must generally provide his own forward impetus and is constantly lifting his feet as he strides, moving the foot and skate forward. The heavy boot fatigues a skater, making the use of an in-line skate less enjoyable.

Thus a need exists for an in-line roller skate boot that is conceived and built with in-line skaters and not snow skiers in mind, that provides skaters with a more comfortable, enjoyable use by cooling and drying their feet; that increases the forward/rearward range of motion available to a skater while preserving the lateral ankle support desired by in-line skaters, and that weighs less and is less fatiguing to use.

OBJECTS OF THE PRESENT INVENTION

It is a principle object of the present invention to provide new and improved apparatus not subject to the foregoing disadvantages.

It is an object of the present invention to provide an in-line roller skate having a boot made of a synthetic material that is cooler and therefore more comfortable for a skater to use.

It is a further object of the present invention to provide an in-line roller skate having a boot made of a synthetic material that is drier and therefore more comfortable for a skater to use.

It is yet another object of the present invention to provide an in-line roller skate having a boot made of synthetic material that has an increased range of motion in the forward/rearward direction and yet continues to provide lateral support to a skater's ankles.

It is still another object of the present invention to provide an in-line roller skate having a boot made of a synthetic material that weighs less than prior art skates.

It is yet another object of the present invention to provide an in-line roller skate having a boot made of a synthetic material that provides improved performance for a skater.

SUMMARY OF THE PRESENT INVENTION

The present invention provides an in-line roller skate that yields improved performance and improved comfort and a method for doing the same. A skate in accord with the present invention includes a boot portion retaining the desirable features of prior art boots and adding novel features that co-act to produce the improvements mentioned.

The boot of the present invention is formed of a synthetic material and has a sole to which a roller means is attached, a whole vamp integral with the sole, a cuff pivotally attached to the vamp, a tongue, and means for tightening the boot onto a foot. At selected locations the vamp has a plurality of ventilating apertures to facilitate the movement of air into and out of the boot. The vamp includes a pair of guide rails that each extend upwardly and rearwardly from the top of the vamp near the front of the boot. Each guide rail is supported by a biasing leg extending from the top of the vamp upwardly to join its respective guide rail. Each guide rail together with its biasing leg and the vamp define a guide rail aperture. Each guide rail has a thickness less than the thickness of the walls of the remainder of the boot.

Skater comfort is improved with the present invention by the use of means to cool and to dry the skater's foot and lower leg. Thus, an in-line roller skate of the present invention includes apertures that allow air to circulate in and around the foot more readily than prior art boots. Heat build-up due to the previously mentioned causes can be dissipated more rapidly by air moving past and into and out of the boot through the apertures.

In addition, cooling is increased by a cooperative air pumping action of the skater and the boot. While a more detailed explanation of this phenomena will be provided below, by way of example, as a skater pushes off, the heel and back portion of the foot are raised slightly in relation to the sole of the boot. Strategically placed ventilating apertures enable air to enter the boot from the outside and to fill the void created by the rising foot. As the foot returns to a position where the heel is once again disposed against the inner sole of the boot, air is forced from the boot through the apertures. In this manner air is pumped into the boot to absorb heat and moisture and is then pumped out carrying the heat and moisture and leaving the foot cooler and drier. Other pumping mechanisms are also included and will be discussed further in the detailed description.

User comfort is further increased by a free-floating wicking liner that syphons moisture from the foot outwardly through the liner to the liner exterior where it is vented to the atmosphere or evaporates. Because evaporation is a cooling process, the skater's foot is kept drier and the skater is more comfortable.

Additionally, the boot may include a detachable tongue that has a smoothly finished outer surface layer and a cushioned inner surface layer where it contacts a skater's foot. The tongue is attached to the boot by means of a projecting member that is mateingly received by an aperture in the vamp of the boot. The tongue's outer surface layer is a stiff but yieldable synthetic material that retains a memory of its shape. As a skater's leg rotates forwardly about the ankle, such as during a push-off, and then backwardly following completion of the push, a restoring force in the outer surface layer of the tongue acts against the leg to return the leg to a proper position for the next push-off. The detachable nature of the tongue allows a user to custom tailor the boot to a desired comfort and performance level.

The boot cuff, which provides ankle support to the user, is pivotally attached to the boot at a pair of pivot points located below and rearward of the ankle. The cuff has a generally crescent shaped configuration and includes means for tightening the cuff around the ankle and lower leg. This tightening means is disposed on the cuff such that the cuff is tightened by drawing the cuff around the front of the leg.

The cuff is capable of pivoting approximately forty-five degrees forwardly from its rest position to allow a range of leg motion not found in other in-line boots. As the cuff pivots forwardly, it slides on the smooth surfaces of the guide rails and the outer layer of the tongue. The increased forward pivoting range of the cuff of a skate in accord with the present invention is achieved in part by the smooth sliding surface presented by the guide rails and in part by the reduced sliding area presented by the guide rail aperture in the region where the cuff slides on the boot when it is pivoted forward in response to leg movement. Additionally, because the cuff tightening means slides on the outer surface layer of the tongue during pivoting, the smooth sliding surface thereof facilitates a sliding motion thereon and provides the tightening means with an unobstructed path on which to move, thereby also contributing to the increased pivoting range of a cuff of the present invention. The increased range improves a skater's performance by allowing stronger push-offs and improves a skater's comfort by increasing the freedom experienced by the leg in a front/rear direction. The increased range of motion further enhances the pumping mechanism noted previously.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

DETAILED DESCRIPTION OF THE INVENTION

Figure 1:
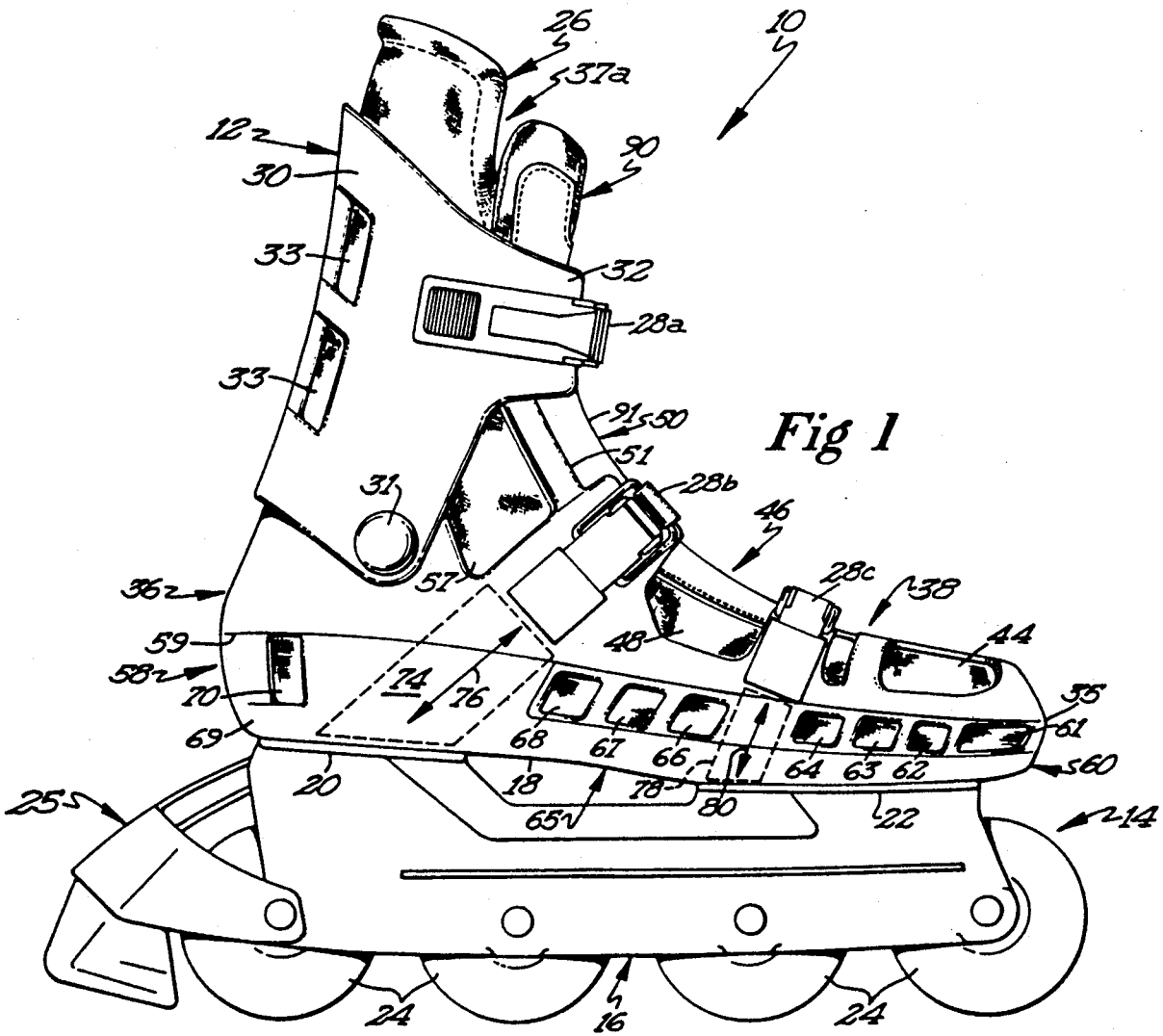
FIG. 1 is a side elevation view of an in-line roller skate according to the present invention.
Figure 2:
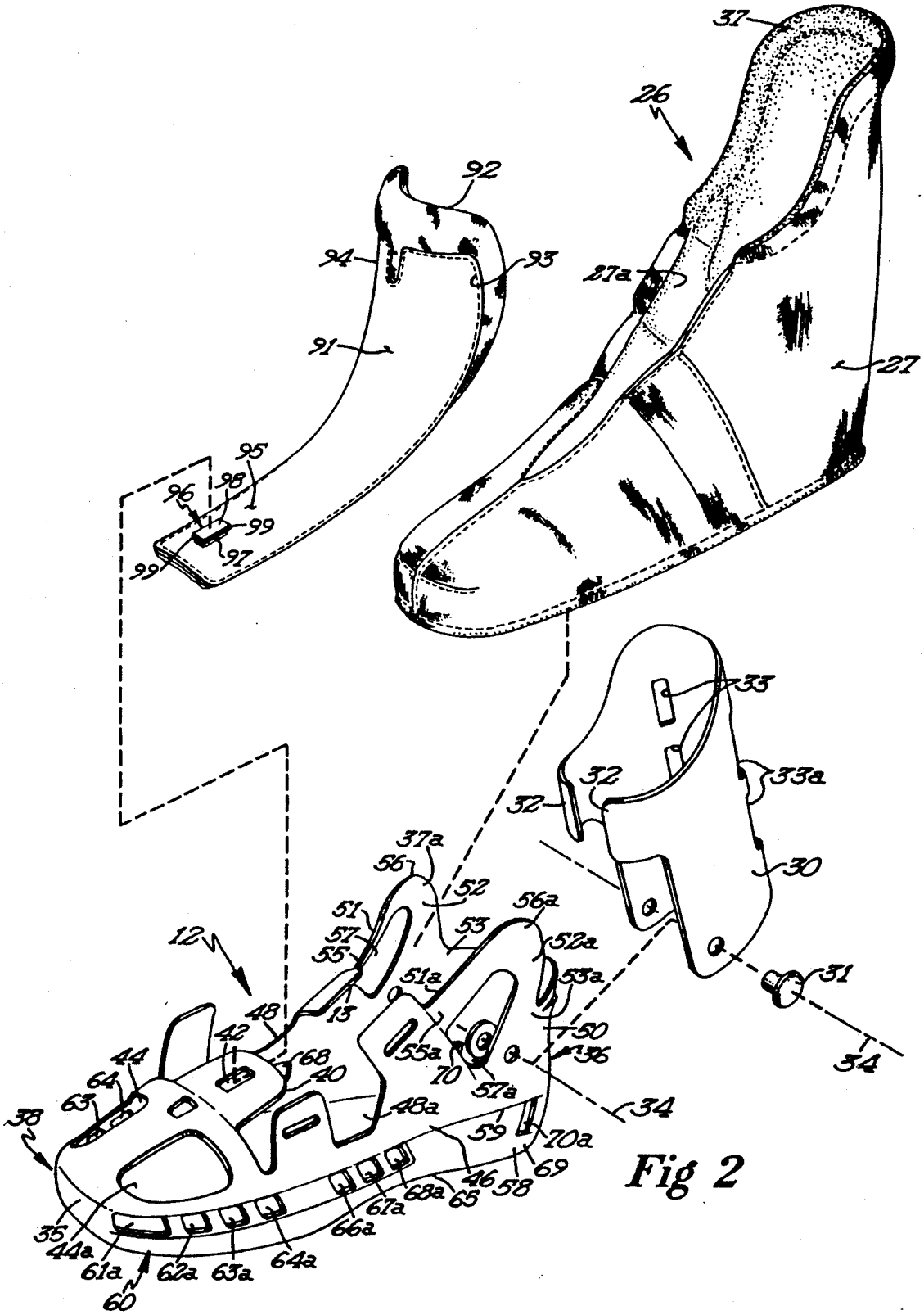
FIG. 2 is an exploded perspective view of the skate boot shown in FIG. 1.

FIGS. 1 and 2 illustrate an embodiment of an in-line roller skate 10 in accordance with the present invention. Skate 10 includes a boot 12 and a roller means 14 attached thereto. Roller means 14 comprises a frame 16 that is attached to a boot sole 18 of boot 12 at a rear sole attachment 20 and a fore sole attachment 22. Frame 16 rotationally supports a plurality of individual wheels 24. While four wheels are shown in the Figures, it is known in the art to use three, four or more wheels attached to a frame and also to skate on as few as two wheels. The present invention is equally useful with other frames and with any number of wheels attached to such frames and all such variations are within the scope of the invention. A brake assembly 25, shown depending from frame 16, may be utilized on boot 12, also.

Boot 12 may be manufactured of a synthetic material such as nylon PEBAX 7033 ®, a polyether block amide material manufactured by Atochem. This material has a good strength to weight ratio and allows boot 12 to be manufactured with thinner walls than found in prior art boots which are commonly made of polyurethane. Because the walls are thinner, the overall weight of the boot is less than would be found in prior art in-line roller skate boots. Additionally, the reduced thickness of the boot walls increases boot flexibility, which allows the boot to more easily conform to a skater's foot during use, thereby providing a better fit as well as reduced weight for the skater.

Also depicted in FIGS. 1 and 2 is a free-floating boot liner 26. Liner 26 is not attached to boot 12 and is therefore able to float or move freely within the boot in response to foot and leg movements. Liner 26 protects the foot from harmful rubbing against the interior of boot 12 thereby reducing the likelihood of blisters and other abrasions during use. Liner 26 includes a foot insertion aperture 37 that extends from the top of liner 26, which, in the embodiment shown, reaches above a skater's ankle to the lower mid-leg region, down the front thereof to the toe region. Liner 26 is formed of an inner mesh material 25 that provides a wicking effect to absorb and draw foot moisture generated by foot and leg perspiration outwardly through the liner and away from the foot to an outer liner 27. From the outer liner surface the moisture may be vented or evaporated into the atmosphere by increasing air flow as will be more fully explained below. The outer liner material, which may be a vinyl material, allows moisture to escape all over or in selected locations only. It may include a nonporous material that is perforated at certain specific locations such as those directly in line with the ventilating apertures to be discussed below.

Boot 12 has a cuff 30 that is pivotally attached thereto using a pivot 31 or other fastening apparatus known to the art. Cuff 30 pivots forwardly and rearwardly about a horizontally disposed pivot axis 34, best seen in FIG. 2. Cuff 30 includes a pair of cooperating cuff extensions 32 between which a buckle **28*a* or other known tightening means is disposed. Cuff 30 further includes a plurality of ventilators 33, 33*a* disposed on the rear portion of the cuff to aid in cooling the skater's foot as described hereafter. Ventilators 33, 33*a* are shown as being vertically defined and as having a substantially elongated parallelogram configuration though other shapes would be effective and are within the scope of the invention. The vertical orientation of these ventilators takes advantage of leg movements and the consequent action of the rising and falling liner 26** to cool and dry the skater as will be clearly set out below.

Boot 12 further includes tightening means **28*b* and 28*c* in addition to tightening means 28*a* by which boot 12 may be tightened onto a skater's foot. As shown in the Figures, boot 12 has three buckle-type tightening means. Boot 12** could have additional or fewer tightening means as desired and could utilize eyelets and lacing or a hooks and loops attachment mechanism such as Velcro ®, all such variations being within the scope of the invention.

For ease of understanding the invention, boot 12 will be discussed in terms of its various regions. Thus, boot 12 includes an upper vamp section 36 to which cuff 30 is pivotally attached and a lower vamp section 58 separated generally from upper vamp section 36 by an imaginary or working line 59, which extends around boot 12, beginning at the front end thereof at approximately the height of the skater's toe in the boot and extending rearwardly to a point slightly below the skaters ankle. Line 59 indicates only a general area of demarcation between the upper and lower sections 36 and 58 respectively. Lower section 58 extends generally perpendicularly upwardly from sole 18 and provides lateral support in the lower foot area. The lower section, then, can be defined generally as that area of the boot extending upwardly from the sole to the height of the lower foot lateral support area of the boot. The area of demarcation provided by imaginary line 59 provides a single, solid ring of boot material surrounding a skater's foot. That is, while it is desirable to provide a selected level of cooling and drying, it is necessary to preserve the structural integrity of boot 12. This area does so by providing the uninterrupted ring of material extending horizontally around the skater's foot.

The upper section 36 includes a foot insertion aperture **37*a* by which a skater may put his foot into the liner 26 of boot 12. Upper section 36 further includes a cap segment 38 that extends from the front of the boot rearwardly to about where a skater's toes join his foot. A mid-foot section 46 extends rearwardly from the cap segment to an area generally in front of the ankle. Upper section 36 also has an ankle segment 50 that extends rearwardly from the front of the ankle to the back of the foot. Lower section 58 includes a toe box 60, an arch segment 65, and a heel segment 69 corresponding respectively with cap segment 38, mid-foot section 46 and ankle segment 50 of upper section 36** in a frontward to rearward progression.

Lower section 58 includes a plurality of ventilating apertures that allow air to circulate into and out of the boot 12 to cool and to dry a skater's foot. As shown in FIG. 2 boot 12 has a total of eight pairs of symmetrically disposed ventilators in lower section 58. Proceeding rearwardly from the front of the boot, a first pair of ventilators 61, **61*a*, has an elongated parallelogram configuration oriented with its long axis substantially parallel to the riding surface. Ventilators 61, 61*a* are separated by a toe protection bar 35 that protects a skater's toes from injury caused by impact and provides forward/rearward structural integrity to boot 12 in the front area thereof. Toe bar 35 extends from sole 18 upwardly and rearwardly over the toes of the skater. Each ventilator 61, 61*a* allows air to be forced into and circulate boot 12 as a skater skates forward. While other configurations for ventilators 61, 61*a* will also suffice, the elongated configuration in combination with toe bar 35 provides a greatly increased cooling and drying air flow into boot 12** while substantially retaining the protection provided by a solid, rigid ski-type boot.

Disposed rearwardly of ventilators 61, **61*a* are a plurality of ventilator pairs 62, 62*a*; 63, 63*a*; and 64, 64*a*. Each of these ventilators has a substantially parallelogram configuration. Each ventilator allows air to flow into and out of boot 12 to cool and dry a skater's foot, principally in the toe and front foot areas. Additionally, each of the ventilators 61, 61***a*; 62, 62*a*; 63, 63*a*; and 64, 64*a* serves as an exhaust vent or port by which heat may be radiated to the environment and moisture evaporated into the air exterior to the boot.

As shown in the figures, the four pairs of ventilators, 61–64*a* inclusive, are depicted in toe box 60. While other numbers of ventilator pairs or individual, non-symmetrically disposed ventilators are also within the scope of the invention, it is desirable that a boot have ventilators disposed near the front of the boot in the lower portion thereof to provide an ingress into the boot for the air rushing by during forward skating.

Disposed on arch segment 65 further rearward of the previously mentioned ventilators are three additional pairs of ventilators 66, 66*a*; 67, 67*a*; and 68, 68*a*; one ventilator of each pair being symmetrically disposed on opposite sides of boot 12. Each of these ventilators has a substantially parallelogram configuration and functions as an inlet port for dry, cool air and an exhaust port for heat and moisture. These ventilators aid in keeping the arch region of a skater's foot cool and dry.

Heel segment 69 includes a pair of ventilators 70, 70*a* to aid in cooling the heel and ankle region, each of these ventilators having a substantially elongated parallelogram configuration. Unlike ventilators 61, 61*a*, however, ventilators 70, 70*a* have a longitudinal axis oriented substantially perpendicularly to the riding surface. These ventilators 70, 70*a* are oriented to take advantage of the upward/downward movement of the heel of a skater within boot 12 during skating. As will be further explained, during a skating stride a skater's foot moves within boot 12 in several complex motions, including a more vertical movement of the heel and ankle region and a more horizontal movement of the toes. Thus forward ventilators 61, 61*a* have an elongated, horizontal orientation to utilize the wide horizontal cross section of the boot and to receive and expel air therein as the toes move rearwardly and forwardly while ventilators 70, 70*a* have an elongated vertical orientation to more readily allow inward and outward air flow under and around the heel as the heel and ankle move upwardly and downwardly to draw and expel air from the boot.

Referring now to upper section 36, cap segment 38 includes a pair of ventilators 44, 44*a* also separated by toe bar 35. Each of these ventilators has a substantially three sided, pie shaped configuration wherein two of the sides are formed by substantially straight lines that join at one end thereof and that are connected at the other along an arcuate edge. Each of these ventilators allows air to enter the boot during skating, and permit heat and moisture to escape by convection. During forward motion of a skater, air is forced into boot 12 through these apertures due to the skater's forward velocity.

Referring still to upper section 36, a pair of ventilators 48, 48*a* is disposed in midfoot section 46. As best seen in FIG. 2, each of these ventilators has an open sided configuration that is partially closed by tongue 90 as seen in FIG. 1. Like ventilators 44 and 44*a*, ventilators 48 and 48*a* allow air to enter and exit the boot during skating and heat and moisture to escape by convection. Air may also be forced into boot 12 through these ventilators during forward motion due to the skater's velocity.

Ankle segment 50 of upper section 36 includes a pair of ventilators 57, 57*a* that also allow air to enter and exit the boot during skating and heat and moisture to escape by convection. Each of these ventilators has a triangular configuration and will be discussed further below.

Each of the ventilators just described, then, can function as an intake and an exhaust port for air within particular regions of boot 12. Additionally the ventilators contribute to the establishment of cross ventilating air currents within the boot. Thus, ventilators disposed on opposite sides of the boot, such as ventilators 61 and 61*a* or 64 and 64*a*, for example, aid in the circulation of air laterally across the foot. Ventilators disposed on the front and rear portions of the boot, such as ventilators 61 and 70 or 70*a*, for example, facilitate the movement of air between the toe and heel regions of the boot. Finally, the ventilators disposed in the upper section 36 and those disposed in the lower section 58 such as ventilators 44 and 66 or 68*a*, for example, help to establish an air flow between the upper and lower reaches of boot 12. The cross ventilation that is established in the boot smoothes out the heat and moisture distribution in the boot, thereby aiding in the prevention of localized hot or damp areas while at the same time cooling and drying the foot generally.

Referring now to FIG. 2, ankle segment 50 includes a pair of guide rails 51, 51*a* extending upwardly and rearwardly therefrom. Each guide rail is made of the same material as boot 12, but has a reduced thickness equal to about seventy-five percent that of the walls of the boot. The guide rails extend from the interior side 13 of boot 12, thereby presenting a comparatively lower surface to cuff 30, which engages the guide rails, than cuff 30 would experience if the guide rails were of a uniform thickness with the rest of the boot walls. Each of the guide rails 51, 51*a* is supported by a biasing leg 52, 52*a*, respectively. Each leg 52, 52*a* has a first end 53, 53*a* respectively, attached to ankle segment 50 of boot 12. Each guide rail 51, 51*a* has a first end 55, 55*a* respectively attached to ankle segment 50 forwardly of where first end 53 is attached. Guide rails 51, 51*a* and biasing legs 52, 52*a* respectively extend upwardly from ankle segment 50 and converge at an apex 56, 56*a* respectively. Guide rails 51 and 51*a* extend substantially from the front portion of ankle segment 50 whereas biasing legs 52 and 52*a* extend substantially from the sides of ankle segment 50. Biasing legs 52, 52*a* prevent guide rails 51, 51*a* respectively from collapsing and help bias them respectively outwardly from a skater's foot and leg. Ventilating apertures 57, 57*a* discussed previously are defined by ankle segment 50 and by guide rails 51, 51*a* and biasing legs 52, 52*a*, respectively.

In operation, cooling and drying of a skater's foot is accomplished through the use of the strategically placed ventilating apertures and a cooperative air-pumping action between the boot and the liner 26 which is actuated by normal movements of the skater's foot and leg.

More specifically, cooling and drying of the skater's foot is accomplished in several ways. First, the use and strategic placement of the ventilators allows and encourages an active interchange of the atmospheric air exterior to the boot with that interior of the boot, as well as air circulation per se within boot 12. This interchange and circulation carries heat and moisture away from a skater's foot and makes the temperature and moisture distribution in the boot more uniform, thereby substantially preventing the establishment of localized hot, damp spots. Second, the ventilators allow heat to escape by a more efficient convective process since heat does not have to pass a nonporous boot in those locations. Third, the action of wicking liner 26 draws moisture from the foot to the areas of the ventilators where it may be expelled from the boot or evaporated. The increased air flow expedites evaporation and the cooling effect of such evaporation further reduces the operating temperature of the boot. In addition, it dries the skater's foot and therefore provides a more comfortable skating experience. Fourth, an in-line skate in accordance with the present invention provides cooling through a cooperative pumping action between the boot and the skater's leg and foot.

Figure 3:
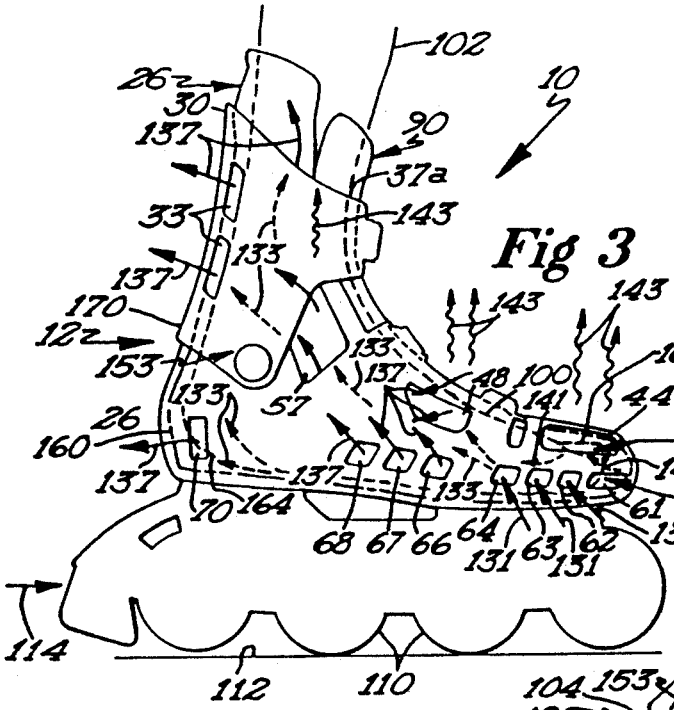
FIG. 3 shows in cross section the in-line skate of FIG. 1 with a skater's foot and leg therein.

Several of these cooling, drying processes are shown in FIG. 3. In discussing this Figure, it will be assumed that the skater is moving in the direction of arrow 114 and, as a result, the skater will encounter a relative airflow moving in the direction of arrow 116. Of course, the actual air flow into and out of boot 12 will depend in part on the ambient air conditions, including wind direction and speed, and the skater's velocity.

FIG. 3 illustrates in cross section a skater's foot 100 and leg 102 disposed within liner 26, which in turn is positioned within boot 12, wherein the skate and foot are shown substantially as they would appear during coasting. The skater's foot 100 lies substantially flush with the inner sole of boot 12 and the leg 102 is in a substantially upright position with cuff 30 also being in an upright position. As shown in these figures, skate 10 is configured such that the skater is skating only on center wheels 100 on skating surface 112 when coasting.

Generally, an air flow will enter boot 12 as indicated by arrows 131 through ventilators disposed in the front portion of boot 12. Thus, as shown in FIG. 3, air will enter through apertures 44, 44*a*; 48, 48*a*; 57, 57*a*; 61, 61*a*; 62, 62*a*; 63, 63*a*; and 64,64*a*. Air entering boot 12 at these locations will act to dissipate the heat and moisture accumulating within the boot and provide a desirable level of cooling in the toe and upper foot regions. Furthermore, as indicated by dotted line arrows 133, a front to rear circulation within the boot will be established. Thus, air flowing into boot 12 as indicated by arrows 131 will flow rearwardly as indicated by dotted line arrows 133 and ultimately exit the boot as indicated by arrows 137 through ventilators 33, 33*a*; 48, 48*a*; 57, 57*a*; 66, 66*a*; 67, 67*a*; 68, 68*a*; and 70, 70*a*. Additionally, air will circulate upwardly along leg 102 and exit through foot insertion aperture 37*a* as indicated.

It is recognized, of course, that due to the atomic nature of the gaseous atmosphere, that air will in fact be exiting and entering boot 12 through each of the ventilators previously described. Further, it should be recognized that due to the positioning and size of various ventilating apertures, air may enter predominantly in one portion thereof while another portion thereof may have a primary outflow of air. Thus, for example, ventilator 48 may, as shown, have a general inflow of air at a rearward most position as indicated by arrow 131 and an outflow from a relatively forward location as shown by arrow 137. The outflow is a result primarily of air previously entering boot 12 from a position forward thereof. Thus, as shown, a general front to rear circulatory pattern is established within boot 12. In addition, an up and down circulation pattern will be established between the ventilators in the upper section of boot 12 and those in the lower section thereof, as generally indicated by arrows 140, 141, respectively. In addition, a convective and radiative heat loss to the environment as indicated b arrows 143 will occur through the ventilators, such as 44 and 44*a*. This type of heat transfer will exceed that of prior art boots because of the presence of the ventilators, which makes the heat transfer easier by the removal of obstructing boot material.

Figure 4:
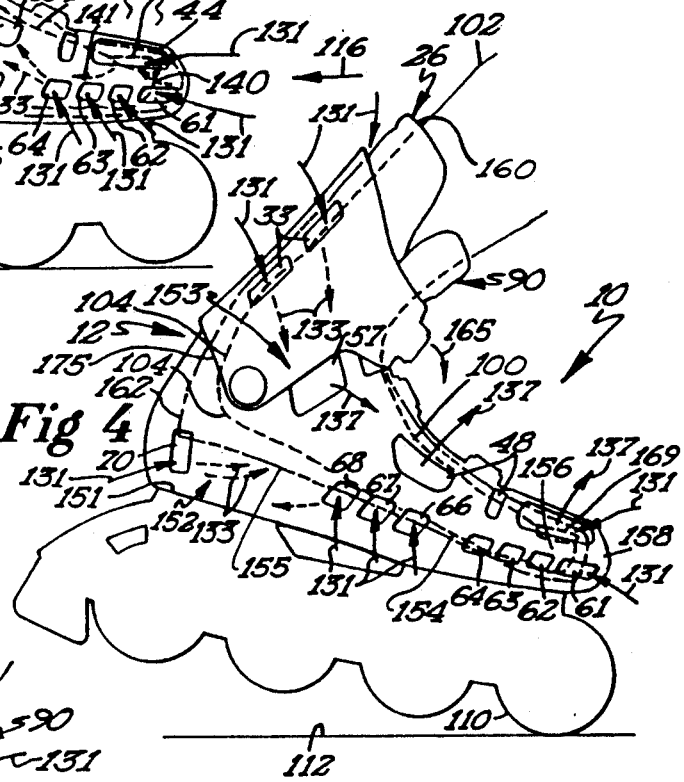
FIG. 4 shows in cross-section the in-line skate of FIG. 1 and the air flow in the boot during the intake phase of a skating stride.
Figure 5:
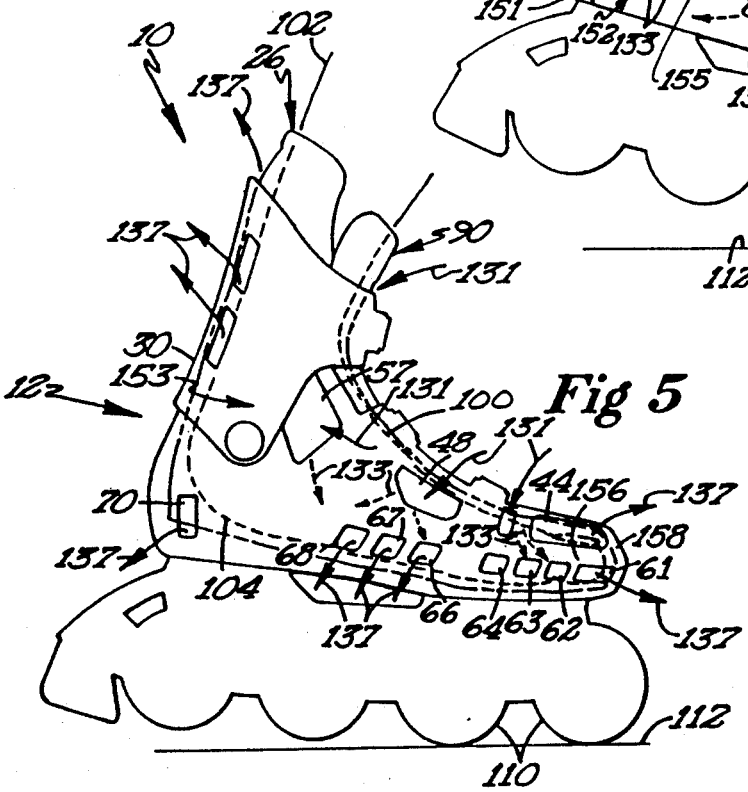
FIG. 5 illustrates in cross-section the air flow out of a boot during the exhaust phase of a skating stride.

FIGS. 4 and 5 illustrate the air pumping process and the cooperation of the various components of boot 12 that successfully cool and dry a skater's foot. Again, in FIGS. 4 and 5 it is assumed that the skater has a generally left to right direction of travel as indicated by arrow 114 and that a relative motion of air thereto is indicated by arrow 116. It will be understood that the relative motion of foot 100 and leg 102 described hereafter are exaggerated to illustrate more graphically the pumping action to be described. The pumping of air into and out of boot 12 begins as an intake stroke. Thus, as a skater begins a stride, he will lean forward and move one leg forward while pushing on the skating surface with the other leg, such as leg 102. As this pushing action occurs, the skate 10 is rotated forwardly such that only the forward most wheels are touching the skating surface 112. The heel 104 of the pushing foot will be lifted slightly off the inner-sole 151 of the boot, carrying free-floating liner 26 upwardly also, and creating a small gap 152 between the liner 26 and inner sole 151 into which air is drawn. This air may enter boot 12 through any of the ventilators shown but will do so primarily through ventilators 68, 68*a* and 70, 70*a*. Ventilators 70 and 70*a* are configured to take particular advantage of the intake stroke since they are oriented with the longitudinal axis of their substantially parallelogram configuration lying substantially parallel with the direction of motion of heel 104 within boot 12. Thus, by orienting ventilators 70, 70*a* such that their longitudinal axis is up and down, a larger, unobstructed access into heel segment 69 is had than would be obtained if their axis lay perpendicular to the direction of heel motion. This larger access makes it easier for air to flow into boot 12 during this intake stroke wherein heel 104 is raised upwardly during a push.

Air is also brought into boot 12 through ventilators 33, 33*a* and insertion openings 37 and 37*a*. As the leg 102 is pivoted forwardly and heel 104 is elevated within boot 12, leg 102 is also pivoted forwardly with respect to cuff 30, carrying liner 26 therewith, and thereby opening a small gap 160 between the top of cuff 30 and liner 26. The creation of this small gap 160 facilitates the entry of air into boot 12 through ventilators 33 and 33*a* and at the top of the boot through insertion openings 37 and 37*a*.

Thus, with the intake stroke, air is brought into boot 12 at rearward and bottom locations, where it is otherwise difficult for air to circulate. As shown in FIG. 3, air circulation in these regions is principally one of a forced out flow due to air moving front to rear within the boot. To any extent that this circulation is not established, cooling and drying of the heel and arch areas will suffer in comparison to the toe and top foot areas, which receive a forced air flow into the boot as noted previously. Thus, the pumping mechanism admirably brings air into the boot at a region that may otherwise experience localized heating.

Additionally, pumping occurs at the front of the boot. Thus, as a skater pushes off (FIG. 4), his leg 102 pivots forwardly around his ankle. At the same time, the heel rises and weight is transferred to the ball 154 of the feet, causing the toes 156 to slide rearwardly from the front of the boot. This enlarges the gap 158 between the liner and the front of the boot into which air may more readily flow. Air may easily enter the boot through ventilators 44, 44*a* and 61, 61*a* as shown by intake arrows 131 during this intake stroke, providing circulation within boot 12 and bringing in cooling, drying air to the front of the boot. Additionally, as weight is removed from the sole portion 155 of wicking liner 26, it inhales incoming air and expands.

A further form of pumping action also occurs with the skate in accordance with the present invention. Thus as previously referred to, as a skater pushes off, his leg is pivoted forwardly (FIG. 4) with respect to the ankle such that cuff 30 pivots forwardly and buckle 28*a* slides downwardly on tongue outer-layer 91 in the direction of tightening means 28*b* as indicated by arrow 165. The skater's leg compresses the front part of liner 26 and, in a manner similar to a sponge, squeezes air and moisture therefrom, which can then exit the boot via the ventilators such as ventilators 44, 44*a*, 48, 48*a* 57, 57*a* in particular. The intake stroke, then, also exhausts some air from the boot and liner, principally along the top of the foot and the front of the leg, thereby forcibly expelling heat and moisture from the boot and cooling and drying the foot.

Referring now to FIG. 5, as the skater completes the push he will bring the pushing leg forward whereby the heel 104 will return to its position flat against the innersole 151 of the boot and consequently expel air through the ventilators. Thus with a boot in accord with the present invention, an interchange of air is accomplished through a pumping action of the foot within the boot. Prior art boots, because of their solid construction did not allow the ready interchange of air found in the present boot.

More particularly, upon the exhaust stroke, as the leg is pulled forward, the toes 156 move forward to position 168, shrinking gap 158 and thereby expelling air from ventilators 44 and 44*a* and 61 and 61*a*. In a full cycle, then, as seen in FIGS. 4 and 5, air is pumped into boot 12 through these ventilators and then exhausted. A supply of cooling and drying air is thus constantly provided to the front of the boot during skating.

Furthermore, as shown in FIG. 5, during the exhaust stroke, heel 104 returns to rest against inner sole 151 of boot 12. As it does so, free floating liner 26 will be carried downward therewith and the material of the liner lying against inner sole 151 will be compressed and air carrying heat and moisture will be expelled therefrom. This air, along with the air in gap 158, which is filled by liner 26 and foot 100 during the exhaust stroke, will be expelled from boot 12 through the ventilators, such as ventilators 33, 33*a*; 66, 66*a*; 67, 67*a*; 68, 68*a*; and 70, 70*a*. In a full cycle as seen in FIGS. 4 and 5, air is forcibly circulated into and out of boot 12 through the boot ventilators, such as ventilators 70 and 70*a*, for example, and consequently provides a continuous supply of cooling and drying air to the boot. As the skate is returned to a near horizontal position by the completion of the push and the forward movement of the pushing leg, liner 26 re-expands in the top and front foot areas and absorbs air from the atmosphere. Ventilators 48 and 48*a* and 57 and 57*a* experience an intake of air, then, as shown by arrow 131, part of which will be expelled during the next pushing stride, as discussed with reference to FIG. 4.

Continuing to describe the exhaust stroke as shown in FIG. 5, as the pushing leg 102 is brought forward in preparation for the next stride, the leg 102 pivots rearwardly at ankle 153, pushing against the rear portion of liner 26 to compresses the liner, thereby expelling air therefrom through ventilators 33 and 33*a* and through the rear portions of insertion openings 37, and 37*a*. Thus, the forward and rearward portions of liner 26 are alternately being compressed and expanded, and consequently air is being alternately expelled and drawn in, respectively. Liner 26 thus aids in generating a constant interchange of air between the interior of the boot and the external atmosphere. In addition, it should be recalled that liner 26 is preferably a wicking liner and actually draws moisture from the foot outward to where it may be vented or evaporated. Further, the free-floating nature of the liner 26 further facilitates cooling and drying of a skater's foot since it helps create gap 152 in boot 12. That is, if liner 26 were affixed to the boot, no gap would be created and the cooling and drying functions would be inhibited.

The ventilators of boot 12 thereby provide a general front to rear flow of air into and out of boot 12 during skating activity. In addition, however, by strategically placing ventilators in both the upper and lower sections of boot 12, an up and down ventilation is achieved, and by disposing ventilators on both sides of the boot, various forms of cross ventilation also occur. All of this ventilation aids in the removal of heat and air from the boot and thereby keeps the skater's foot drier, cooler and more comfortable, thus making in-line skating a more enjoyable sport.

It is important to note that placement of each of the ventilators is intended to provide a desired level of cooling and drying while retaining the necessary structural strength of boot 12. In this regard, it should be noted that as best seen in FIG. 1, tightening means 28*b* and 28*c* each exert a tightening force that defines a line of tightening stress in boot 12 as indicated by double headed arrows 76 and 80 respectively. Since each tightening means exerts a tightening force across the width thereof, a pair of zones 74 and 78 as indicated by the dotted lines on FIG. 1, are created in association with stress lines 76 and 80 respectively wherein it is preferable that no ventilating or fitting apertures should be placed. These zones preserve the structural integrity of the boot. It should also be noted that none of the ventilators extend across imaginary line 59, which, as previously noted, assures that the boot has needed structural support. Finally, a column 82 of boot material is provided from sole 18 to the top of ankle segment 50 in the heel region, helping to maintain appropriate lateral ankle support. Thus, even after placing the described apertures in boot 12, the structural integrity of the boot is maintained, thereby preserving lateral ankle support and the desired protective features of a hard, rigid ski-type boot.

It should be noted that cuff ventilators 33 are disposed such that they would be within an area directly in-line with the closure stress exerted by tightening means 28*a*. These ventilators however are disposed on the rear portion of cuff 30 where resistance to bending is not as important. Where strength is important, such as the lateral portions of cuff 30 that provide lateral support for the skater's ankles, the side portions of cuff 30 are preferably more solid material.

Ventilators disposed as shown retain needed lateral stiffness in the lower vamp section where lateral support to a skater's foot is important. In addition, while fewer or greater numbers of ventilators and various will now suggest themselves to those skilled in the art, all of which fall within the spirit and scope of the present invention. Accordingly it is intended that the invention be limited only by the scope of the appended claims.

What is claimed is:

1. An in-line roller skate comprising:

a boot having an integrally molded outer shell and a sole formed from a semi-rigid material, the outer shell and sole defining a cavity sized for receiving a skater's foot;

roller means comprising a frame and a plurality of in-line wheels, the frame adapted for attachment to the sole and for rotationally supporting the plurality of wheels;

a free-floating liner received within the boot and surrounding the foot of a skater, the liner at least partially moveable with respect to the boot;

wherein the boot includes a plurality of substantially unobstructed apertures, the apertures being sized to permit air to freely circulate into and out of the boot cavity, the apertures further being sized and adapted to permit heat and moisture to be more easily expelled from the boot cavity;

said apertures spaced and positioned for air to be drawn into and forced out of said cavity through said apertures during a skating motion to enable and facilitate dispersed air circulation within said cavity;

wherein during said skating motion, said semi-rigid outer shell, said free floating liner, said foot and said apertures cooperate to create an air-pumping action, such that said skating motion results in relative movement between said liner and said outer shell thus defining a continuous cycle of said air-pumping action which draws air into and forces air out of said boot's cavity through said apertures.

2. The in-line roller skate of claim 1 wherein said liner is at least semi-permeable to air and moisture at positions in general alignment with said apertures.

3. The in-line roller skate of claim 1 wherein said boot includes a lower vamp, and said plurality of substantially unobstructed apertures are positioned along said lower vamp.

4. The in-line roller skate of claim 1 wherein said plurality of substantially unobstructed apertures comprise at least a forward aperture and a rearward aperture, the forward and rearward apertures positioned along a side of said boot.

5. The in-line skate of claim 1 wherein said boot includes a midfoot portion comprising a lower arch portion and an upper midfoot segment, wherein said plurality of substantially unobstructed apertures comprises at least two apertures positioned within the midfoot portion.

6. The in-line skate of claim 1 wherein said boot further includes a pivotally attached cuff, said plurality of substantially unobstructed apertures comprising a pair of apertures positioned on said cuff.

7. The in-line skate of claim 1 wherein said boot includes a midfoot portion, comprising a lower arch segment and an upper midfoot segment; and an ankle portion; wherein said plurality of substantially unobstructed apertures comprises an aperture positioned in the midfoot portion and an aperture positioned in the ankle portion.

8. The in-line skate of claim 1 wherein said boot further includes a pivotally attached cuff which includes at least one of said apertures, and wherein said outer shell comprises:

a toe portion, comprising a lower toe box segment and an upper cap segment, said toe portion including at least one of said apertures;

a midfoot portion comprising a lower arch segment and an upper midfoot segment, said midfoot portion including at least one of said apertures; and a heel portion, said heel portion including at least one of said apertures.

9. An in-line roller skate useable on the foot and lower leg of a skate and providing improved performance and comfort for the skater skating on a skating surface, said skate comprising:

a boot formed from a stiff, resilient synthetic material and including a sole and a boot upper section and said boot having an inner surface, said boot upper section including:

a foot insertion aperture;

a cuff pivotally attached to said boot upper section, said cuff comprising a stiff material, said cuff being swingable through a predetermined arc between a first upright position and a second position forwardly inclined from said first position, said cuff including a means for tightening said cuff around the lower leg of a skater; and a pair of low friction guide rails disposed on said boot upper section underlying and contacting said cuff, said guide rails providing low friction contact with said cuff as said cuff swings through said predetermined arc between said first upright position and said second position, each of said guide rails comprising a member extending from said inner surface of said boot, each said member having an elongate configuration and having a thickness less than the thickness of the boot in the area from which it extends; and said skate further comprising roller means attached to said sole.

10. The skate of claim 9 wherein:

said boot upper section includes an ankle segment and wherein each of said guide rails extends upwardly and rearwardly from said ankle segment, each of said guide rails being supported by a biasing leg for preventing said guide rail from collapsing by biasing it outwardly, each said biasing leg extending upwardly and forwardly from said ankle segment to join said guide rail, each of said guide rails and its respective biasing leg together with said ankle segment cooperating to define a guide rail aperture therebetween, and wherein said cuff includes a smooth inner surface that slides on said guide rails as said cuff pivots.

11. The skate of claim 9 wherein:

said boot upper section includes a tongue; and said cuff is partly defined by a pair of cuff extensions that extend forwardly and overlie said boot tongue, said cuff extensions sliding on said tongue as said cuff pivots.

12. The skate of claim 9 wherein said cuff is pivotable through an arc of about forty-five degrees about a substantially horizontal axis between said first upright position and said second inclined position.

13. The skate of claim 9 wherein said boot upper section further includes:

a tongue, said tongue including an outer-layer having upper and lower portions and other configurations of ventilators can be utilized with the present invention, the shown arrangement and number represent a preferred embodiment.

Guide rails 51 and 51*a* along with apertures 57 and 57*a* further aid in the ventilation of boot 12. As previously noted, prior art boots had a substantially thick walled construction were resistant to lateral flexing of any kind. Additionally, some prior art boots included a pair of cuff supports extending upwardly from the rear portion of ankle segment 50 interiorly of cuff 30 that were resistant to forward bending, thereby further restricting the pivoting range of prior art boots. As a result of these pivoting restrictions, prior art boot cuffs were resistant to any forward pivoting of the cuff greater than about five to ten degrees with a foot in the boot. By contrast, the cuff attached to a boot of the present invention is capable of pivoting forwardly from a first upright position 170 to a second forwardly inclined position 175 through an arc of approximately 45 degrees, and back again rearwardly to the upright position and ankle movement is thus limited only by the physical dexterity of the skater's ankle. With a foot in boot 12, a cuff pivoting range of up to twenty-five degrees is available.

This extreme range of pivoting provided by cuff 30, which far exceeds that available in prior art boots, helps boot 12 to provide a unique cooling ability that is unknown in the art. The great pivoting range facilitates the pumping actions just discussed in that it allows greater swinging motion of leg 102 about ankle 153 than was available in prior art boots and therefore creates greater opportunity for the exchange of air. This occurs because the greater the range through which the leg can pivot about the ankle in a stride, the higher the heel is likely to be raised within the boot and the greater gap 152 will become. Similarly, the greater the magnitude of the pivoting arc, the greater is the back and forth range of motion of the toes within the boot and the greater gap 158 will become. As gap size increases, so does circulation and, accordingly, so does the cooling and drying of the skater's foot.

When a skater's leg pivots around the skater's ankle, such as during a push-off or stride, cuff 30 will pivot forwardly about axis 34 of cuff pivot 31, cuff extensions 32 slide downwardly toward buckle 28, and cuff 30 will slidingly rotate downwardly on guide rails 51. The pivoting of cuff 30 is aided by and is a function of several factors. Some of these are the guide rails 51, 51*a* upon which cuff 30 slides; the smooth finished tongue outer-layer 91 to be discussed below, upon which the cuff extensions 32 slide; the ventilators 57 57*a*, which provide an unobstructed reduced friction sliding path for cuff 30, and the use of a thinner more flexible material for cuff 30 and boot 12. Guide rails 51 and 51*a* in combination with apertures 57 and 57*a* provide a smooth, reduced sliding surface area that minimizes pivoting friction with cuff 30. Thus, cuff 30 will more easily pivot and will do so with a greater degree of motion than will cuffs found in prior art boots. Pivoting is further aided by a smooth inner surface on cuff 30.

The comparative ease with which cuff 30 pivots as well as its pivoting range not only facilitates the cooling and drying functions of boot 12 but also increases the performance ability of the skater. As is well known, increasing the flexibility and the range of motion through which a muscle can move results in a corresponding increase in the muscle's efficiency and strength output. Thus, by increasing the pivoting arc of the cuff, the leg and foot of a skater can achieve a greater range of motion relative to the other. Consequently, the strength of the skater's leg is increased and the skater is able to skate faster and more efficiently, incur less fatigue, and if capable, is more able to perform acrobatic maneuvers such as jumping.

Boot 12 may also include a detachable tongue 90. This feature of the present invention will be described with reference to FIG. 2, and one means of attaching it to boot 12 will be illustrated. Thus as shown in FIG. 2 tongue 90 includes a tongue outer-layer 91 that is attached to a tongue inner-layer 92 by means of stitching 93. Other means of attaching the tongue outer-layer 91 to the tongue inner-layer 92 are known and are within the purview of the present invention. Tongue 90 is defined by an upper tongue portion 94 and a lower tongue portion 95 upon which a tongue button 96 is disposed. Tongue button 96 includes a button shaft 97 having a substantially rectangular cross-sectional configuration extending upwardly therefrom though other configurations would serve equally well. Tongue button 96 further includes a button plate 98 that is integral with button shaft 97 and that has a pair of button lips 99 extending longitudinally forward and rearwardly therefrom.

The tongue attachment means further includes a cap segment extension 40 extending rearwardly from cap segment 38 as best seen in FIG. 2. Tongue extension 40 includes a tongue extension aperture 42 that is configured to receive button 96 and together therewith to removably attach tongue 90 to boot 12. Tongue extension aperture 42 will closely receive shaft 97 of button 96 when tongue 90 is attached to boot 12. Lips 99 Will extend forwardly and rearwardly of extension aperture 42 and will function to retain shaft 97 within extension aperture 42.

Tongue outer-layer 91 is preferably a synthetic material having a smooth surface finish to facilitate the sliding of buckle 28A as cuff 30 pivots forwardly with a skater's leg. Layer 91 is preferably made of a material having a shape retaining memory. That is, following its manufacture, tongue outer-layer 91 has a rest shape to which it will seek to return when it is flexed therefrom. Preferably this rest shape will conform to a skater's foot and leg position prior to beginning a stride. Thus, as a skater pivots his leg forward around the ankle, such as during a push off, upper tongue portion 94 is pivoted forwardly with respect to lower tongue portion 95. As the skater moves his leg forward to complete the stride, tongue 90 acting through tongue outer-layer 91 will exert a restoring force on the skater's foot and leg to return tongue 90 to its rest position. Because the rest position conforms to the proper position for beginning a subsequent stride, tongue 90 will aid the skater in returning skate 10 to its proper position for such a subsequent stride. The detachable nature of tongue 90 allows a skater to custom fit a particular skate according to comfort and performance level. A skater can thereby rely in part on the restoring force exhibited by tongue 90 rather than solely on muscle memory and strength to return skate 10 to a proper position for a subsequent stride. The skater's performance level will accordingly increase.

Thus, a novel in-line skating boot, built and constructed with the specific demands of in-line skating in mind has been set forth.

Having thus described the present invention, numerous substitutions, modifications and alterations thereof attachment means for removably attaching said tongue to said boot.

14. The skate of claim 13 wherein:

said boot upper section includes a cap segment; and said attachment means includes a cap segment extension projecting rearwardly from said cap segment, said cap segment extension having an attachment aperture and a top and a bottom and wherein said means further includes an attachment member attached to said tongue lower portion for removable insertion into said aperture from said bottom side thereof.

15. The skate of claim 13 wherein:

said tongue is relatively flexible between a rear rest position and a forward flexed position in response to a stride by a skater, and said tongue outer layer is formed of a material having a shape memory such that as said tongue is flexed forward said tongue exerts a restoring force against said skater's leg to return said skate to said rest position in preparation for a succeeding stride.

* * * * *

UNITED STATES PATENT AND TRADEMARK OFFICE

CERTIFICATE OF CORRECTION

PATENT NO. : 5,171,033

DATED : December 15, 1992

INVENTOR(S) : Brennan J. Olson et al.

It is certified that error appears in the above-identified patent and that said Letters Patent is hereby corrected as shown below:

Column 1, line 8, delete "BACKGROUND OF THE PRESENT INVENTION" after the word "skates."

Column 3, line 55, "syphons" should read--siphons--

Column 4, line 55, "cross section" should read--cross-section--

Column 7, line 40, "cross section" should read--cross-section--

Column 9, line 23, "cross section" should read--cross-section--

UNITED STATES PATENT AND TRADEMARK OFFICE

CERTIFICATE OF CORRECTION

PATENT NO. : 5,171,033

DATED : December 15, 1992

INVENTOR(S) : Brennan J. Olson et al.

It is certified that error appears in the above-identified patent and that said Letters Patent is hereby corrected as shown below:

Column 10, line 2, "b" should read--by--

Column 12, line 3, "compresses" should read--compress--

Signed and Sealed this

Twenty-eighth Day of December, 1993

*Attest:*

BRUCE LEHMAN

*Attesting Officer*

*Commissioner of Patents and Trademarks*